US011937681B2

(12) United States Patent
Joung

(10) Patent No.: US 11,937,681 B2
(45) Date of Patent: Mar. 26, 2024

(54) COSMETICS CONTAINER SIMULTANEOUSLY PREVENTING LEFTOVER COSMETICS THEREIN AND HAVING AIRTIGHT FUNCTION

(71) Applicant: Jae Yong Joung, Anyang-si (KR)

(72) Inventor: Jae Yong Joung, Anyang-si (KR)

( * ) Notice: Subject to any disclaimer, the term of this patent is extended or adjusted under 35 U.S.C. 154(b) by 582 days.

(21) Appl. No.: 17/262,465

(22) PCT Filed: Mar. 5, 2019

(86) PCT No.: PCT/KR2019/002522
§ 371 (c)(1),
(2) Date: Jan. 22, 2021

(87) PCT Pub. No.: WO2020/022602
PCT Pub. Date: Jan. 30, 2020

(65) Prior Publication Data

US 2021/0219697 A1 Jul. 22, 2021

(30) Foreign Application Priority Data

Jul. 23, 2018 (KR) ..... 10-2018-0085126
Nov. 21, 2018 (KR) ..... 10-2018-0144186

(51) Int. Cl.
*A45D 40/26* (2006.01)
*A45D 34/04* (2006.01)
(Continued)

(52) U.S. Cl.
CPC ..... *A45D 34/042* (2013.01); *B65D 51/32* (2013.01); *A45D 2034/002* (2013.01);
(Continued)

(58) Field of Classification Search
CPC ..... A45D 34/042; A45D 34/045; A45D 2034/002; A45D 40/26; A45D 40/262; A45D 40/265; A45D 40/267; B65D 51/32
See application file for complete search history.

(56) References Cited

U.S. PATENT DOCUMENTS 4,175,574 A * 11/1979 Zulberti ..... A45D 40/267 401/122
2015/0007843 A1* 1/2015 Zhang ..... A45D 40/262 132/200

FOREIGN PATENT DOCUMENTS

KR 20-1998-0063566 U 11/1998
KR 10-0849129 B1 11/2008
(Continued)

*Primary Examiner* — Rachel R Steitz
(74) *Attorney, Agent, or Firm* — Heedong Chae; Lucem, PC

(57) ABSTRACT

A cosmetics container simultaneously preventing leftover cosmetics therein and having an airtight function, the cosmetics container including a container main body in which cosmetics are accommodated; a rotating member rotatably coupled to the container main body, and having a cosmetics guide tube extending from the lower side thereof so as to be inserted into the container main body; a container cap for opening and closing the container main body; a brush rod extending from the lower side of the container cap so as to be inserted into the cosmetics guide tube, and having an applicator provided at the end portion thereof; and a piston screw-coupled to the outer periphery of the cosmetics guide tube of the rotating member while the outer peripheral surface thereof comes in close contact with the inner peripheral surface of the container main body.

5 Claims, 12 Drawing Sheets

(51) Int. Cl.

| | |
|---|---|
| ***B65D 51/32*** | (2006.01) |
| *A45D 34/00* | (2006.01) |
| *B65D 83/00* | (2006.01) |

(52) U.S. Cl.
CPC ..... *A45D 40/265* (2013.01); *A45D 2200/055* (2013.01); *B65D 83/0016* (2013.01)

(56) References Cited

FOREIGN PATENT DOCUMENTS

| | | | |
|---|---|---|---|
| KR | 10-2011-0074549 | A | 6/2011 |
| KR | 10-2011-0079599 | A | 7/2011 |
| KR | 10-2011-0079997 | A | 7/2011 |
| KR | 20-2012-0002769 | U | 4/2012 |

* cited by examiner

--PRIOR ART--

COSMETICS CONTAINER SIMULTANEOUSLY PREVENTING LEFTOVER COSMETICS THEREIN AND HAVING AIRTIGHT FUNCTION

TECHNICAL FIELD

One aspect of the present disclosure relates to a cosmetics container simultaneously preventing leftover cosmetics therein and having an airtight function, and more particularly, to a cosmetics container simultaneously preventing leftover cosmetics therein and having an airtight function, the container having a rotating member rotatably coupled to a container main body, having a cosmetics guide tube extending from the lower side of the rotating member so as to be inserted into the container main body, and having threads formed on the outer periphery of the cosmetics guide tube so as to allow a piston to be screw-coupled to the outer side thereof such that the piston screw-coupled to the cosmetics guide tube of the rotating member pushes the cosmetics accommodated in the container main body up into the cosmetics guide tube while moving downwards by the rotation of the rotating member, and thus the cosmetics can be applied to an applicator even if a brush rod is not inserted into the lower part of the container main body.

BACKGROUND ART

In general, cosmetic products have been thought to be used by women, however, all ages and sexes use cosmetic products to enhance their appearances in the modern society.

The cosmetic products may be classified into solid cosmetics, liquid cosmetics, and gel cosmetics according to the type of cosmetics. The solid cosmetics are mainly used after accommodated in compact containers, put on a puff and spread over an area to be used. The liquid or gel cosmetics are contained in various containers according to their use and used after being directly discharged, squeezed out of a soft material such as a tube, discharged by using a pump, or applied by putting cosmetics contained in the container on an applicator.

Among the above schemes for using the liquid or gel cosmetics, the scheme of putting the cosmetics on the applicator is mainly used during makeup on delicate areas such as eyelashes and lips, and a brush, a tip and the like are mainly used as the applicator.

The cosmetic container used in the above manner is composed of a cap screwed to the container containing the cosmetics, a brush rod extending downward from the cap, and an applicator coupled to a lower end of the brush rod. The applicator is accommodated inside the container as the cap is screwed to the container, and then the cap is removed from the container upon makeup, so that and the cosmetic put on the applicator of the cap is applied to the makeup area.

However, when the conventional cosmetic container as described above accommodates cosmetics having high viscosity, such as mascara liquid, in the container, the cosmetics remains on an inner wall of the container, and accordingly the cosmetics cannot be entirely used, thereby causing wastes. In addition, whenever the cap is removed from the container, the cosmetics remaining on an inner wall of the container are continuously exposed to the outside and deteriorated or hardened, and accordingly become unusable.

In order to solve the conventional problems, Korean Patent Registration No. 10-1400178 discloses a cosmetic container as shown in FIG. 1. The conventional cosmetic container includes: a main body for accommodating cosmetic liquid; a first packing member coming in close contact with an upper end of the main body and having an entry and exit hole vertically formed through a central portion thereof; a cap coupled to an upper outer surface of the main body to open and close an upper portion of the first packing member; a brush connecting rod extending longitudinally from a center of a bottom surface of the cap, passing through the entry and exit hole, and having an end attached to a brush and a second packing member coming in close contact with an inner surface of the main body, moving vertically, and having a through-hole through which the brush connecting rod and the brush pass.

In other words, the conventional cosmetic container has a structure in which a negative pressure is generated inside the container upon removing the cap from the container, external air flows into the container, the second packing member is moved to downward, and the cosmetic is collected downward by the second packing member.

However, according to the conventional cosmetic container, when the cap is removed and the connecting rod and the brush are taken out, the connecting rod and the brush pass through the through-hole of the second packing member, so the second packing member is separated from an upper surface of the cosmetics while being caught by the connecting rod and the brush and moved upward together, and accordingly, the second packing member fails to properly function to collect the cosmetics downward.

In addition, according to the conventional cosmetic container, when the cap is coupled to the container the connecting rod and the brush push the second packing member downward, thereby causing the cosmetics to overflow to an upper portion of the second packing member. When the cosmetic container is stored or carried in an upside down state, some cosmetics leak out through a gap between the second packing member and the connecting rod, so the top of the container becomes dirty, and the overflowing or leaking cosmetics become unusable.

DISCLOSURE

Technical Problem

One aspect of the present disclosure is provided to solve the above problems. An object of one aspect of the present disclosure is to provide a cosmetics container simultaneously preventing leftover cosmetics therein and having an airtight function, in a cosmetic container including a container main body, a container cap for opening and closing the container main body, and a brush rod extending downward from the container cap and having an applicator at an end thereof the container having a rotating member rotatably coupled to a container main body, having a cosmetics guide tube extending from the lower side of the rotating member so as to be inserted into the container main body, and having threads formed on the outer periphery of the cosmetics guide tube so as to allow a piston to be screw-coupled to the outer side thereof such that the piston screw-coupled to the cosmetics guide tube of the rotating member pushes the cosmetics accommodated in the container main body up into the cosmetics guide tube while moving downwards by the rotation of the rotating member, and thus the cosmetics can be applied to an applicator even if a brush rod is not inserted into the lower part of the container main body.

In addition, an object of one aspect of the present disclosure is to provide a cosmetics container simultaneously preventing leftover cosmetics therein and having an airtight function, in which the piston is moved to the lower side of the container main body while coming in close contact with the inner peripheral surface of the container main body by the rotation of the rotating member to downwardly sweep the cosmetics put on the inner peripheral surface of the container main body, so that the cosmetics contained in the container main body may be entirely used without remaining.

Technical Solution

One aspect of the present disclosure provides a cosmetics container simultaneously preventing leftover cosmetics therein and having an airtight function, the cosmetics container including: a container main body accommodated therein with cosmetics; a rotating member rotatably coupled to the container main body, and having a cosmetics guide tube extending from a lower side thereof so as to be inserted into the container main body; a container cap for opening and closing the container main body; a brush rod extending from the lower side of the container cap so as to be inserted into the cosmetics guide tube, and having an applicator provided at the end portion thereof, and a piston screw-coupled to the outer periphery of the cosmetics guide tube of the rotating member while the outer peripheral surface thereof comes in close contact with the inner peripheral surface of the container main body.

In addition, an inner peripheral surface of the container main body and an outer peripheral surface of the piston may have a polygonal shape.

In addition, the rotating member may include an inlet portion, a cosmetics guide tube extending downward from the inlet portion, and a coupling portion spaced apart from the cosmetics guide tube at a predetermined interval and extending downward.

In addition, the inlet portion, the cosmetics guide tube, and the coupling portion of the rotating member may be formed integrated with each other or may be formed separately and coupled to each other.

In addition, when the rotating member is entirely or partially rotated, the piston screw-coupled to the cosmetics guide tube of the rotating member downwardly sweeps the cosmetics put on the inner peripheral surface of the container main body while the piston is moved downward, and simultaneously the cosmetics contained in the container main body is pushed upward into the cosmetics guide tube.

Advantageous Effects

The cosmetics container simultaneously preventing leftover cosmetics therein and having an airtight function according to one aspect of the present disclosure, in the cosmetic container including a container main body, a container cap for opening and closing the container main body, and a brush rod extending downward from the container cap and having an applicator at an end thereof, has a rotating member rotatably coupled to a container main body, has a cosmetics guide tube extending from the lower side of the rotating member so as to be inserted into the container main body, and has threads formed on the outer periphery of the cosmetics guide tube so as to allow a piston to be screw-coupled to the outer side thereof such that the piston screw-coupled to the cosmetics guide tube of the rotating member pushes the cosmetics accommodated in the container main body up into the cosmetics guide tube while moving downwards by the rotation of the rotating member, and thus the cosmetics can be applied to the applicator even when the brush rod is not inserted into the lower part of the container main body. Thus, the use can be convenient.

In addition, according to the cosmetics container simultaneously preventing leftover cosmetics therein and having an airtight function of one aspect of the present disclosure, the piston is moved to the lower side of the container main body while coming in close contact with the inner peripheral surface of the container main body by the rotation of the rotating member to downwardly sweep the cosmetics put on the inner peripheral surface of the container main body, so that the cosmetics contained in the container main body can be entirely used without remaining.

BEST MODE

Mode for Invention

The present invention and technical objects implemented by the present invention will be apparent from the following preferred embodiments. Hereinafter, one embodiment of the cosmetic container simultaneously preventing leftover cosmetics therein and having an airtight function according to one aspect of the present disclosure will be described in detail as follows with reference to the accompanying drawings.

Figure 1:
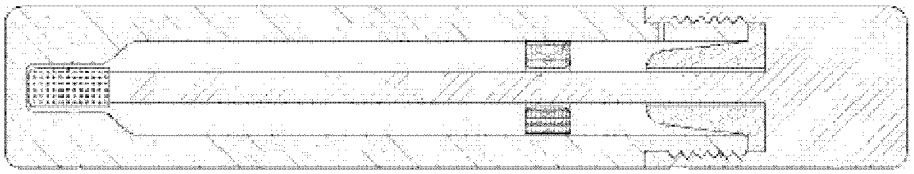
FIG. 1 is a view showing a conventional cosmetic container.
Figure 2:
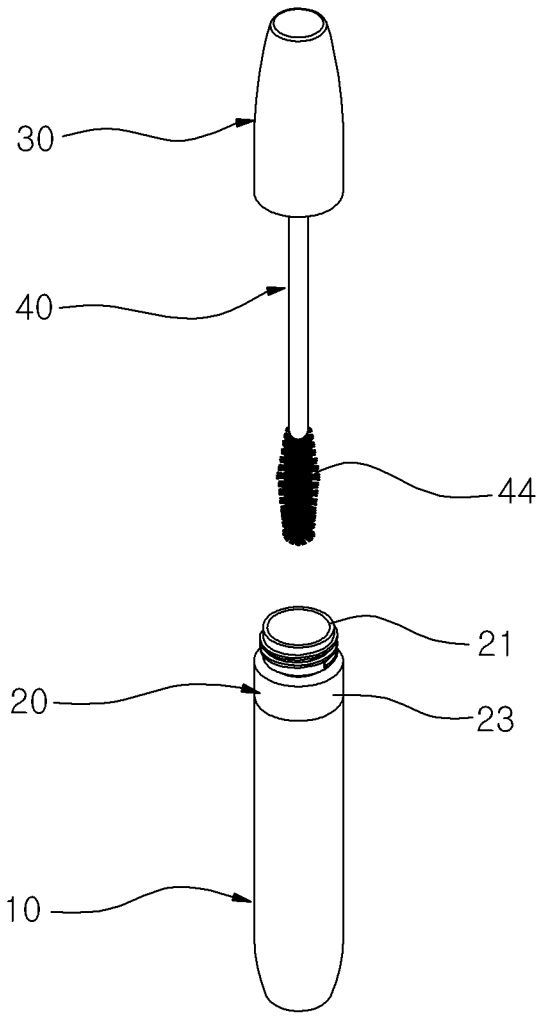
FIG. 2 is a perspective view of a cosmetic container according to one embodiment of one aspect of the present disclosure.
Figure 3:
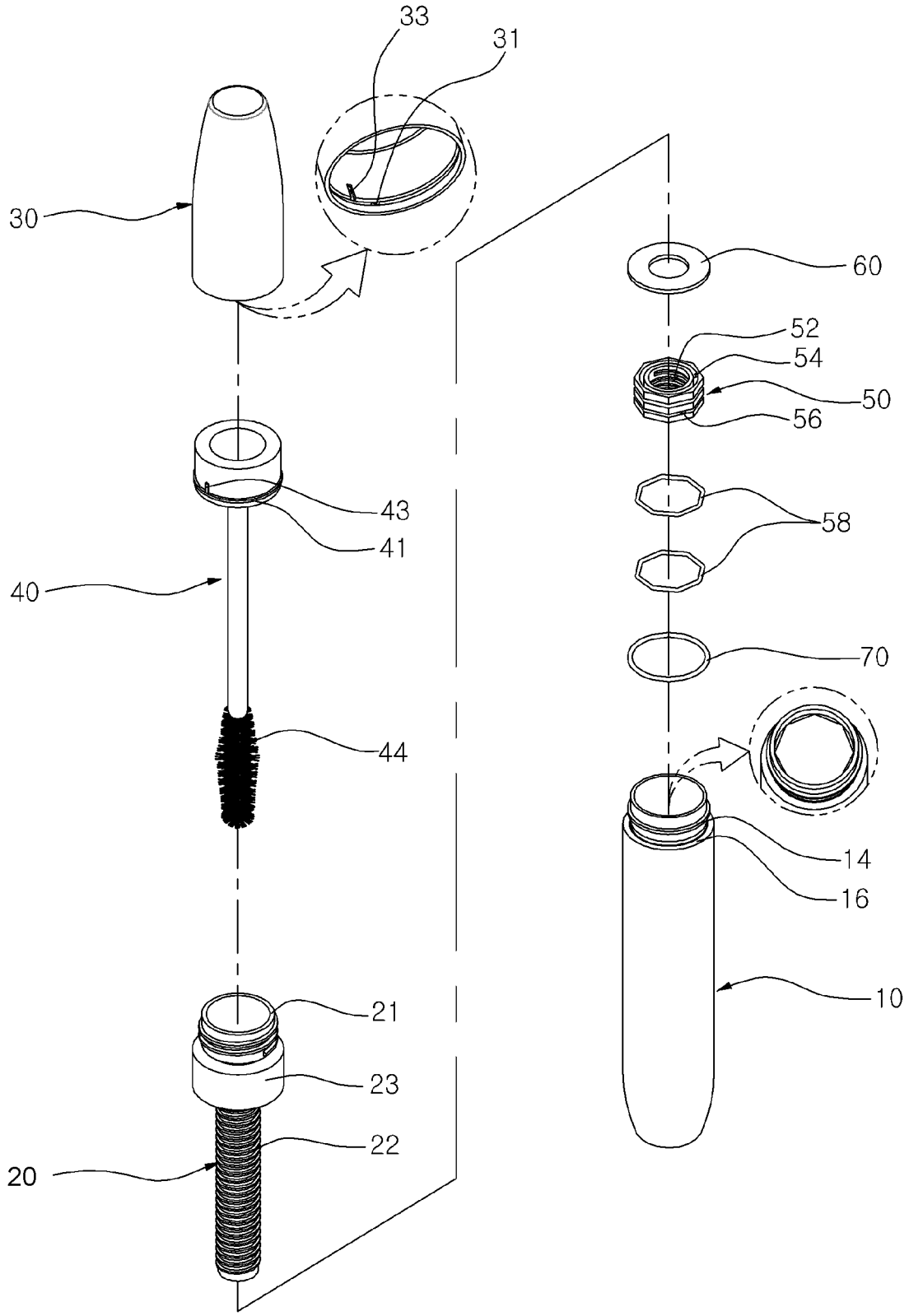
FIG. 3 is an exploded perspective view of a cosmetic container according to one embodiment of one aspect of the present disclosure.
Figure 4:
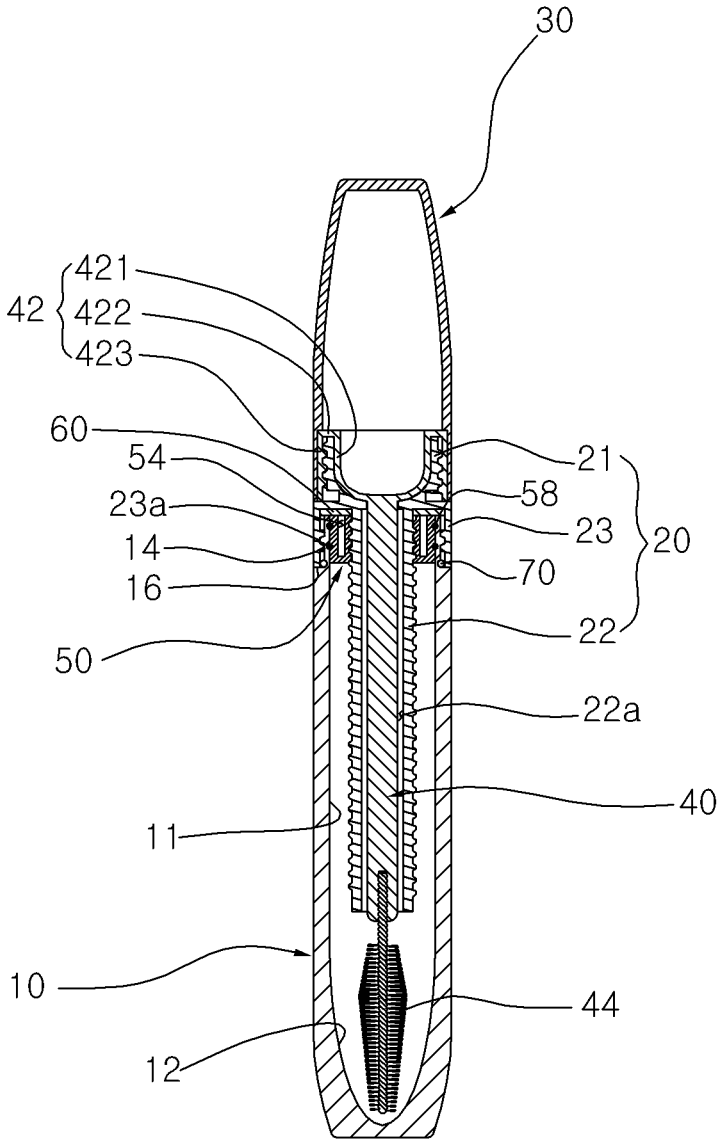
FIG. 4 is a sectional view of a cosmetic container according to one embodiment of one aspect of the present disclosure.

FIG. 2 is a perspective view of a cosmetic container according to one embodiment of one aspect of the present disclosure. FIG. 3 is an exploded perspective view of a cosmetic container according to one embodiment of one aspect of the present disclosure. FIG. 4 is a sectional view of the cosmetic container according to one embodiment of one aspect of the present disclosure.

One aspect of the present disclosure includes: a container main body 10 accommodated therein with cosmetics; a rotating member 20 rotatably coupled to the container main body 10, and having a cosmetics guide tube 22 extending from a lower side thereof so as to be inserted into the container main body 10; a container cap 30 for opening and closing the container main body 10; a brush rod 40 extending from the lower side of the container cap 30 so as to be inserted into the cosmetics guide tube 22, and having an applicator 44 provided at the end portion thereof, and a piston 50 screw-coupled to the outer periphery of the cosmetics guide tube 22 of the rotating member 20 while the outer peripheral surface thereof comes in close contact with the inner peripheral surface of the container main body 10.

Liquid or gel cosmetics are accommodated in the container main body 10, and in particular, cosmetics having a high viscosity such as mascara may be accommodated. The container main body 10 is formed in a cylindrical shape having an open top, and the cosmetics are filled through the open portion.

As shown in the partially enlarged view of FIG. 3, the container main body 10 has an inner peripheral surface formed as a polygonal shape. This is because a piston 50 screw-coupled to the cosmetics guide tube 22 is configured to be moved vertically without being rotated together when the cosmetics guide tube 22 of the rotating member 20 is rotated. The inner peripheral surface of the container main body 10 may be formed in a cylindrical shape other than the polyhedral shape, and vertical grooves and vertical protrusions may be formed on the inner peripheral surface of the container main body 10 and the outer peripheral surface of the piston 50, respectively, so as to be fitted with each other so as to prevent the piston 50 from being rotated together with the cosmetics guide tube 22.

As shown in FIG. 4, an inner vertical surface (11) and an inner curved surface (12) having a curved shape inclined toward a center of the container main body 10 under the vertical surface (11) may be formed on the inner peripheral surface of the container main body 10. The piston 50 is moved to a lower side of the container main body 10 in a section of the inner vertical surface (11). When the piston 50 passes the section of the inner vertical surface (11) and enters a section of the inner curved surface (12), an inner diameter of the container main body 10 becomes smaller than an outer diameter of the piston 50, so that the piston 50 is no longer moved to the lower side of the container main body 10.

An upper outer circumference of the container main body 10 is formed with a coupling protrusion wheel 14 so as to be rotatably coupled to the rotating member 20, and a mounting step 16 is formed under the coupling protrusion wheel 14 so that a lower end of the rotating member 20 is mounted thereon.

As shown in FIG. 4, the rotating member 20 is rotatably coupled to an open upper portion of the container main body 10.

The rotating member 20 may include an inlet portion 21, a cosmetics guide tube 22 extending downwardly from et portion 21, and a coupling portion 23 outwardly spaced apart from the cosmetics guide tube 22 at a predetermined interval and extending downwardly.

The inlet portion 21 serves as an outlet through which the brush rod 40 is inserted or withdrawn, and an inner circumference of the inlet portion 21 has a shape inclined toward a center of the rotating member 20, so that the cosmetics applied to the inlet portion 21 may easily flow into the container main body 10. In addition, a thread is formed on the outer circumference of the inlet portion 21 so as to be screw-coupled to an upper part of the brush rod 40.

In addition, an upper outer circumference of the brush rod 40, that is, an outer circumference of an inner wall 421 of a fastening portion 42 has a shape corresponding to the inlet portion 21 of the rotating member 20 so as to be in close contact with each other, so that the sealing force of the container main body 10 may be strengthened. In addition, a wiper (not shown) may be provided inside the inlet portion 21 or inside the cosmetics guide tube 22 adjacent to the inlet portion 21, so that contents put on the outer circumference of the brush rod 40 and an outer circumference of the applicator 44 of the brush rod 40 may be swept away when the brush rod 40 comes out of the container main body 10.

The cosmetics guide tube 22 is inserted into the container main body 10 through the open portion of the container main body 10. The cosmetics guide tube 22 is formed therein with a brush rod insertion space **22*a* into which the brush rod 40 is inserted, and a thread is formed on the outer circumference of the cosmetics guide tube so as to be screw-coupled to the piston 50. The cosmetics guide tube 22** may be formed of various materials such as synthetic resin or metal, and particularly, may be formed of polyketone that is one of thermoplastic polymers.

The coupling portion 23 is rotatably coupled to the upper outer circumference of the container main body, in which a coupling groove **23*a* is formed in the inner circumference of the coupling portion 23 so as to be coupled to the coupling protrusion wheel 14 of the container main body 10. A lower end of the coupling portion 23 is mounted on the mounting step 16 of the container main body 10**.

A circular ring-shaped sealing packing 60 may be formed between the cosmetics guide tube 22 and the coupling portion 23. The sealing packing 60 comes in close contact with the upper end of the container main body 10 to seal the container main body 10. In addition, a sealing ring 70 may be further provided on an upper portion of the mounting step 16 of the container main body 10, in which the sealing ring 70 is inserted between the upper outer circumference of the container main body 10 and the coupling portion 23 of the rotating member 20 to further seal the inside of the container main body 10. In addition, it is preferable that the sealing packing 60 and the sealing ring 70 are formed of a soft material to improve the sealing force inside the container main body 10.

Figure 10:
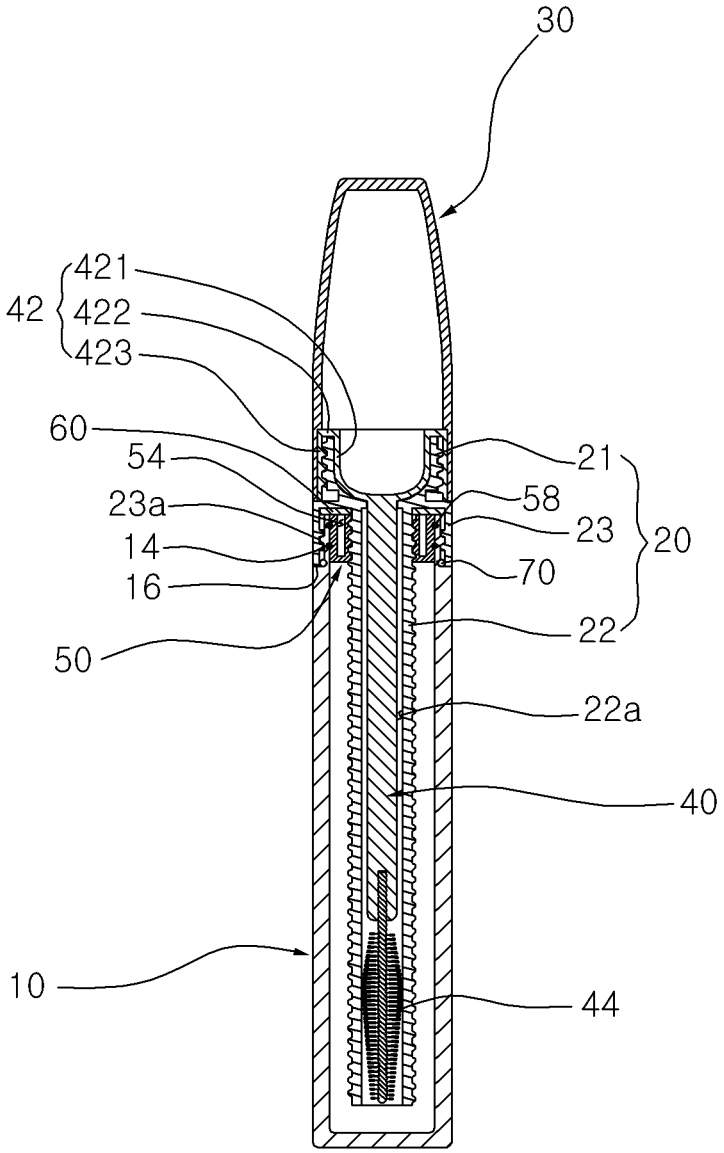
FIG. 10 is a sectional view of a cosmetic container according to another embodiment of one aspect of the present disclosure.
Figure 11:
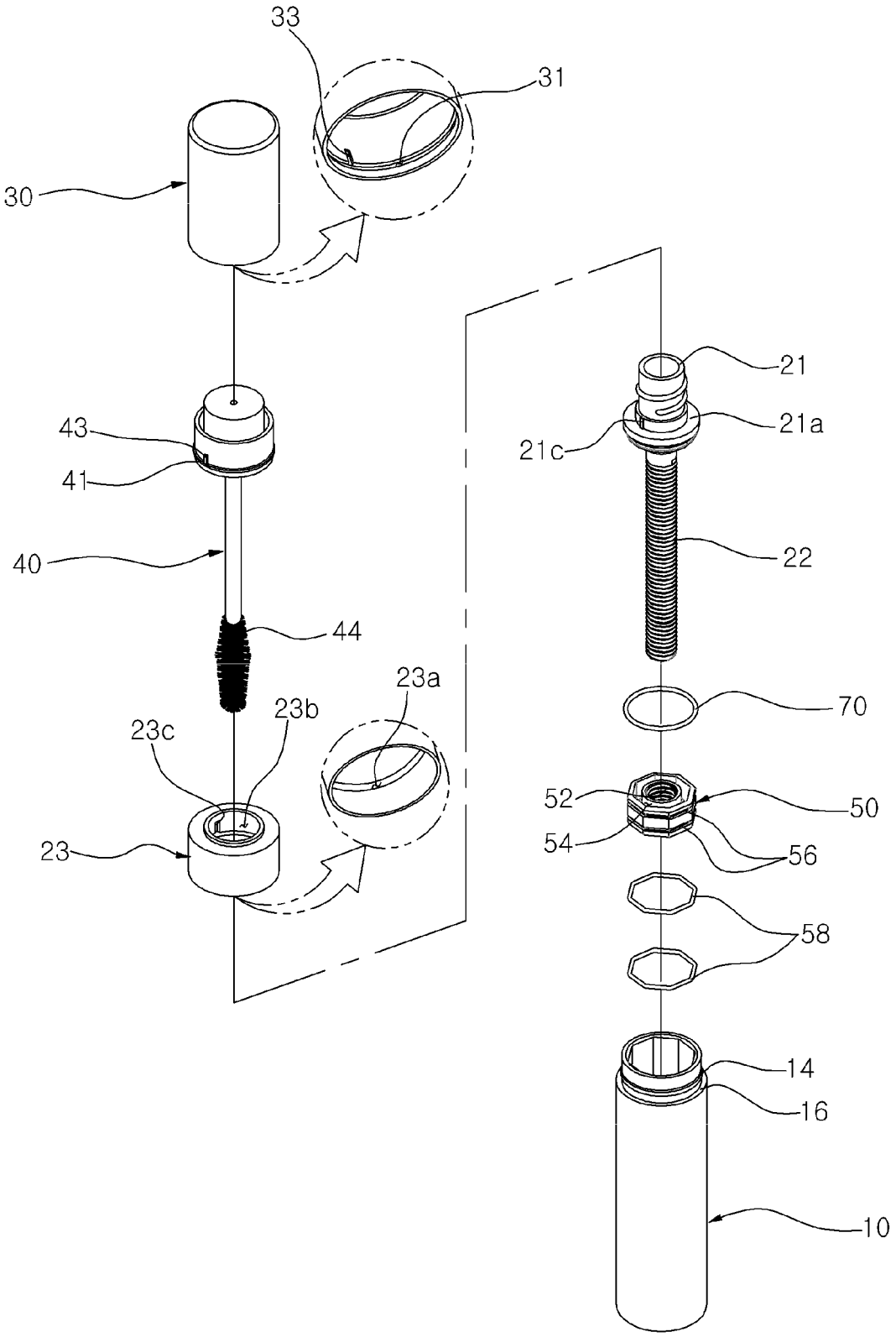
FIG. 11 is an exploded perspective view of a cosmetic container according to still another embodiment of one aspect of the present disclosure.
Figure 12:
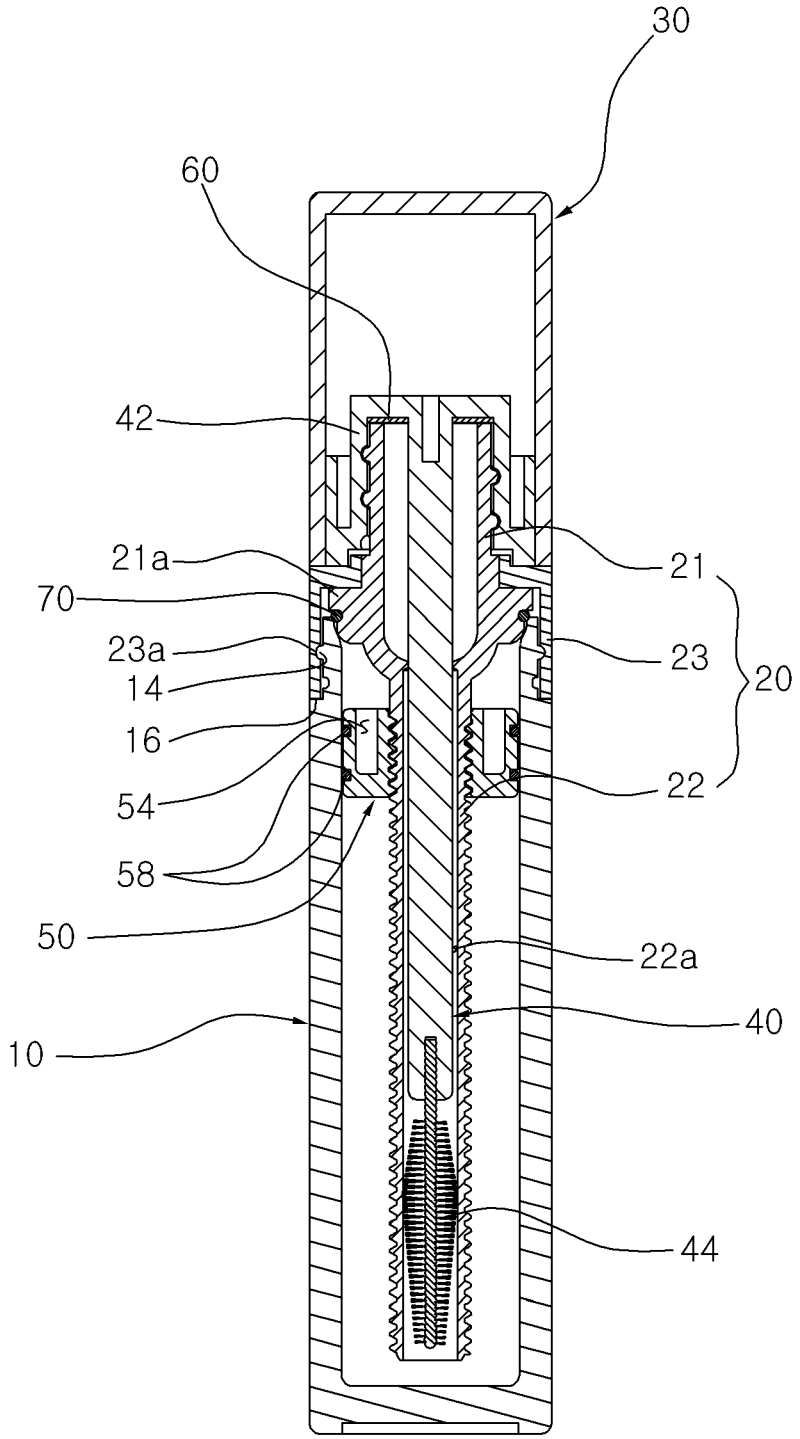
FIG. 12 is a sectional view of a cosmetic container according to still another embodiment of one aspect of the present disclosure.

FIGS. 10 to 12 are views of cosmetic containers according to another embodiment and still another embodiment of one aspect of the present disclosure. With reference to the above drawings, the cosmetic containers according to another embodiment and still another embodiment of one aspect of the present disclosure will be described.

First, FIG. 10 is a sectional view of the cosmetic container according to another embodiment of one aspect of the present disclosure. FIG. 11 is an exploded perspective view of the cosmetic container according to still another embodiment of one aspect of the present disclosure. FIG. 12 is a sectional view of the cosmetic container according to still another embodiment of one aspect of the present disclosure.

The cosmetic container according to another embodiment of one aspect of the present disclosure may not be formed such that the cosmetics guide tube 22 covers the brush rod 40 portion except for the applicator 44 as shown in FIG. 4, and may be formed such that the cosmetics guide tube 22 having a length thither extending downward to cover the entire lower portion of the brush rod 40 including the applicator 44 as shown in FIG. 10.

In addition, in the cosmetic container according to still another embodiment of one aspect of the present disclosure, the rotating member 20 may be formed separately into two or more parts and be coupled to each other as shown in FIG. 11.

In other words, the inlet portion 21 and the cosmetics guide tube 22 of the rotating member 20 may be integrally formed along a longitudinal direction of the rotating member 20, and the coupling portion 23 of the rotating member 20 may be separately formed and coupled to an outer side of the inlet portion 21.

A sealing protrusion wheel 21*a* protrudes outward from the outer circumference of the inlet portion 21 of the rotating member 20. As shown in FIG. 12, at least a part of the sealing protrusion wheel 21*a* is fitted to an upper inner circumference of the container main body 10 to cover the upper end of the container main body 10, thereby sealing the inside of the container main body 1. In addition, the sealing ring 70 is provided on the outer circumference of the sealing protrusion wheel 21*a* so as to come in close contact with the upper inner circumference of the container main body 10, and the sealing packing 60 is provided in an upper inner side of the brush rod 40 so as to come in close contact with the upper end of the inlet portion 21 of the rotating member 20, so that the sealing force inside the container main body 10 may be further improved.

In addition, a coupling groove 23*a* coupled to the coupling protrusion wheel 14 of the container main body 10 is formed in the inner circumference of the coupling portion 23 of the rotating member 20, and a through-hole 23*b* through which the inlet portion 21 passes is formed in a center thereof. When the rotating member 20 is coupled to the container main body 10, the lower end of the coupling portion 23 of the rotating member 20 is mounted on the mounting step 16 of the container main body 10, and simultaneously, an upper rim portion of the coupling portion 23 presses the upper end of the sealing protrusion wheel 21*a* of the inlet portion 21 to prevent the inlet portion 21 and the cosmetics guide tube 22 from being separated from the container main body 10.

At this point, when the inlet portion 21 of the rotating member 20 is coupled to the coupling portion 23 while passing through the coupling portion 23, the inlet portion 21 and the coupling portion 23 may be fixedly coupled and rotated together, or only the inlet portion 21 may be rotated while the coupling portion 23 is fixed. More specifically, as shown in FIG. 11, a rotation prevention protrusions 21*c* and a rotation prevention groove 23*c* may be formed on the outer circumference of the inlet portion 21 and the inner circumference of the coupling portion 23, respectively, so as to be rotated together without being idle to each other, or the inlet portion 21 may be coupled to the coupling portion 23 without the rotation prevention structure so that only the inlet portion 21 with the cosmetics guide tube 22 integrally formed at the lower side thereof may be separately rotated without rotating the coupling portion 23.

The container cap 30 opens and closes the container main body 10, and serves as a handle during makeup. As shown in FIG. 3, a fastening groove 31 and a rotation prevention groove 33 may be formed at a lower inner circumference of the container cap 30.

The brush rod 40 is coupled to a lower portion of the container cap 30, extends downward from a lower side of the container cap 30, and is inserted into the cosmetics guide tube 22 of the rotating member 20.

As shown in FIG. 4, the fastening portion 42 is formed on the upper portion of the brush rod 40, in which the fastening portion 42 is composed of an inner wall 421, a connecting piece 422 extending outward from an upper portion of the inner wall 421, and a lower extending protrusion wheel 423 extending downward from the connecting piece 422. An outer circumference of the inner wall 421 has a shape inclined toward a center of the brush rod 40 and comes in close contact with the inlet portion 21 of the rotating member 20, and a thread is formed on an inner circumference of the lower extending protrusion wheel 423 and screw-coupled to the thread formed on the outer circumference of the inlet portion 21 of the rotating member 20. The rotating member 20 and the brush rod 40 have been shown as being detached to each other through the screw-coupling in the drawings of one aspect of the present disclosure, however, one aspect of the present disclosure is not limited thereto, and various types of coupling structures, such as undercut coupling, slide coupling, coupling by a magnet and a magnetic member, may be implemented.

In addition, a fastening protrusion 41 is formed on the outer circumference of the fastening portion 42 of the brush rod 40 so as to be coupled to the fastening groove 31 of the container cap 30, and a rotation prevention protrusion 43 is formed to be inserted into the rotation prevention groove 33 of the container cap 30. Accordingly, the brush rod 40 is fixedly coupled without being separated from the container cap 30 and being idle.

An applicator 44, which is used to dip cosmetics contained in the container main body 10 and apply the cosmetics onto a cosmetic area, is coupled to one end of the brush rod 40. As shown in HG 3, the applicator 44 may be formed as a mascara brush, and also may be changed in various shapes according to the area or purpose to be applied in addition to the mascara brush.

The piston 50 serves as an airtight function of sealing the inside of the container main body 10. As shown in FIG. 4, the piston 50 is screw-coupled to the outer circumference of the cosmetics guide tube 22 of the rotating member 20 and moved downward within the container main body 10 by rotation of the rotating member 20.

The piston 50 has a center thereof with a guide tube through-hole 52 through which the cosmetics guide tube 22 passes, and has an outer peripheral surface coming in close contact with an inner peripheral surface of the container main body 10. As shown in FIG. 3, the outer peripheral surface of the piston 50 may have a polygonal shape corresponding to the inner peripheral surface of the container main body 10. In other words, as described above, when the inner peripheral surface of the container main body 10 is formed in a cylindrical shape other than the polyhedral shape, the outer peripheral surface of the piston 50 is also formed in a cylindrical shape, vertical grooves and vertical protrusions may be formed on the inner peripheral surface of the container main body 10 and the outer peripheral surface of the piston 50, respectively, so as to be fitted with each other, so that the piston 50 may be moved vertically without being rotated together with the cosmetics guide tube 22.

An elastic space 54 may be formed inside the piston 50, in which the elastic space 54 is configured to allow the piston 50 to elastically come in close contact with the inner peripheral surface of the container main body 10.

In addition, the piston 50 is preferably formed of any one or more materials of thermoplastic elastomer (TPE), low density polyethylene (LDPE), synthetic polymer, rubber, and silicone or formed of a material having elasticity such as polypropylene or polyethylene. The piston 50 is not limited to the above-described materials, and may be formed of various materials within a range having a predetermined elasticity.

In addition, at least one sealing ring insertion groove 56 may be formed in the outer peripheral surface of the piston 50, and a piston sealing ring 58 may be fitted into the sealing ring insertion groove 56. The piston sealing ring 58 may prevent the cosmetic material from leaking between the outer peripheral surface of the piston 50 and the inner peripheral surface of the container main body 10. The piston sealing ring 58 preferably has a shape corresponding to the outer peripheral surface of the piston 50.

As described above, according to one aspect of the present disclosure, the cosmetics guide tube 22 is provided inside the container main body 10, and the piston 50 is screw-coupled to the outer circumference of the cosmetics guide tube 22 to allow the piston 50 to push the cosmetics to the bottom of the container main body 10 while being moved downward by the rotation of the rotating member 20, thereby preventing the leftover of the cosmetics and improving the usability of the cosmetic container having the airtight function.

In other words, according to the conventional cosmetic container, when viscous cosmetics such as mascara cosmetics is contained inside the container, the cosmetics remains on an inner wall of the container, and accordingly the cosmetics cannot be entirely used, thereby causing wastes. In addition, when the cosmetics contained in the container are almost exhausted, the cosmetics are applied to the applicator only when the brush rod and the applicator are inserted up to the inner bottom of the container, thereby causing the inconvenience in use.

In order to solve the above problem, the cosmetic container according to one embodiment of one aspect of the present disclosure is configured such that the rotating member 20 is rotatably coupled to the container main body 10, in which the cosmetics guide tube 22 extends downward from the rotating member 20 and is inserted into the container main body 10, and the piston 50 is screw-coupled to the outer circumference of the cosmetics guide tube 22 to bring the outer peripheral surface of the piston 50 into close contact with the inner peripheral surface of the container main body 10, so that the piston 50 screw-coupled to the cosmetics guide tube 22 of the rotating member 20 sweeps the cosmetics on the inner peripheral surface of the container main body 10 downward while being moved downward by the rotation of the rotating member 20, and simultaneously, the cosmetics contained in the container main body 10 is pushed upward into the cosmetics guide tube 22. Thus, according to one aspect of the present disclosure, even when a user does not insert the brush rod 40 up to the bottom portion of the container main body 10, the cosmetics may be uniformly applied to the entire applicator, thereby leading to the convenience in use. In addition, all the cosmetics remaining on the inner wall of the container main body 10 may be used without the remains.

The assembling method of the cosmetics container simultaneously preventing leftover cosmetics therein and having an airtight function according to the embodiments of one aspect of the present disclosure configured in the above manner will be described in detail as follows.

In order to assemble the cosmetic container according to one aspect of the present disclosure, first, the cosmetics are filled inside the container main body 10 through the open portion of the container main body 10 as shown in FIGS. 3 and 4.

Next, prior to coupling the rotating member 20 to the container main body 10, the sealing packing 70 is inserted and attached between the cosmetics guide tube 22 and the coupling portion 23 of the rotating member 20, and the piston 50 is screw-coupled to the outer circumference of the cosmetics guide tube 22 and moved to the upper portion of the cosmetics guide tube 22.

Next, the sealing ring 70 is fitted onto the upper outer circumference of the container main body 10, and the rotating member 20 is rotatably coupled to the upper portion of the container main body 10, in which the coupling protrusion wheel 14 formed on the outer circumference of the container main body 10 is coupled to the coupling groove 23*a* formed on the inner peripheral surface of the coupling portion 23 of the rotating member 20.

Meanwhile, as shown in FIGS. 11 and 12, when the inlet portion 21 and the cosmetics guide tube 22 are separately formed with the coupling portion 23 of the rotating member 20, the piston 50 is screw-coupled to the outer circumference of the cosmetics guide tube 22 and moved to the upper portion of the cosmetics guide tube 22 in a state where the sealing ring 70 is fitted onto the outer side the sealing protrusion wheel a of the inlet portion 21, and the inlet portion 21 passes through the through-hole 23*b* of the coupling portion 23, and then the coupling portion 23 is rotatably coupled to the container main body 10.

Next, the brush rod 40 is coupled to the lower portion of the container cap 30, in which the fastening protrusion 41 and the rotation prevention protrusion 43 formed on the outer circumference of the fastening portion 42 of the brush rod 40 are coupled to the fastening groove 31 and the rotation prevention groove 33 formed in the lower inner circumference of the container cap 30, respectively. At this point, the applicator 44 is coupled to the lower end of the brush rod 40.

Next, the brush rod 40 extending downward from the container cap 30 is inserted into the cosmetics guide tube 22 of the rotating member 20 to allow the brush rod 40 and the rotating member 20 to be screw-coupled to each other. Thus, the assembly of the cosmetics container simultaneously preventing leftover cosmetics therein and having an airtight function according to one aspect of the present disclosure is finished.

The using method of the cosmetics container, which is assembled in the above manner, simultaneously preventing leftover cosmetics therein and having an airtight function will be described in detail with reference to the accompanying drawings.

Figure 5:
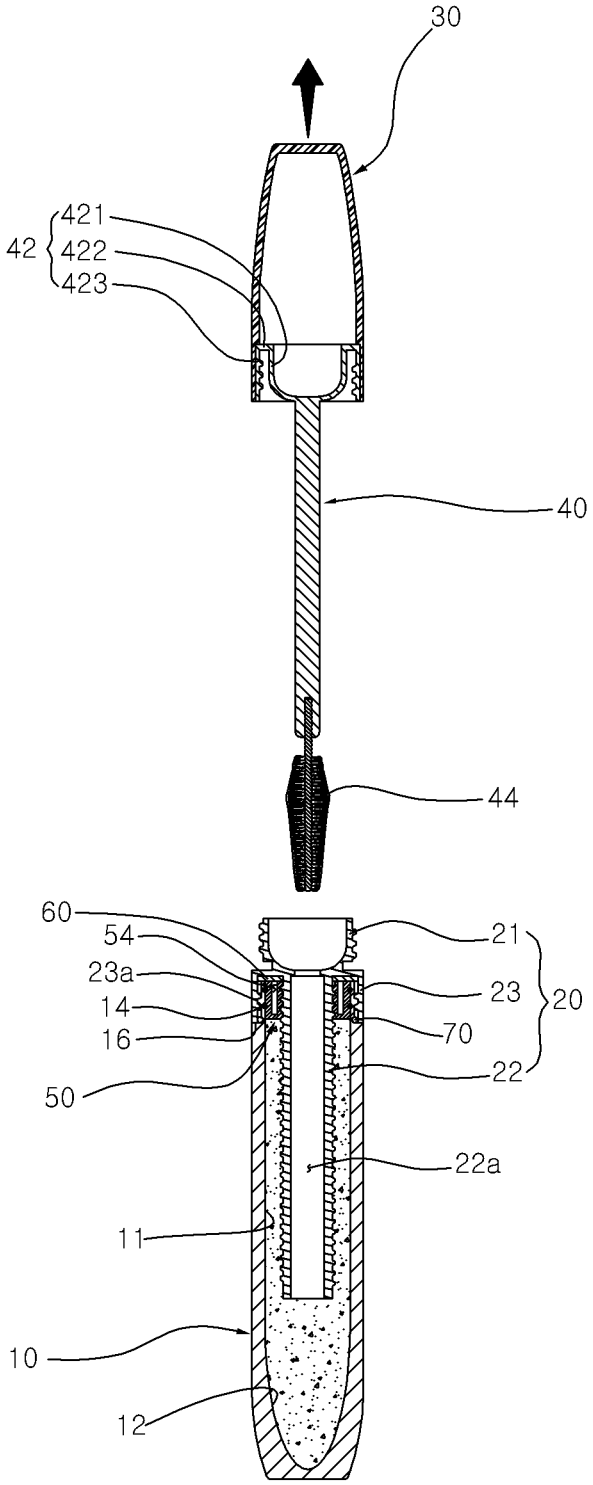
FIG. 5 is a sectional view showing a state in which a container cap is separated from a container main body of the cosmetic container according to one embodiment of one aspect of the present disclosure.
Figure 6:
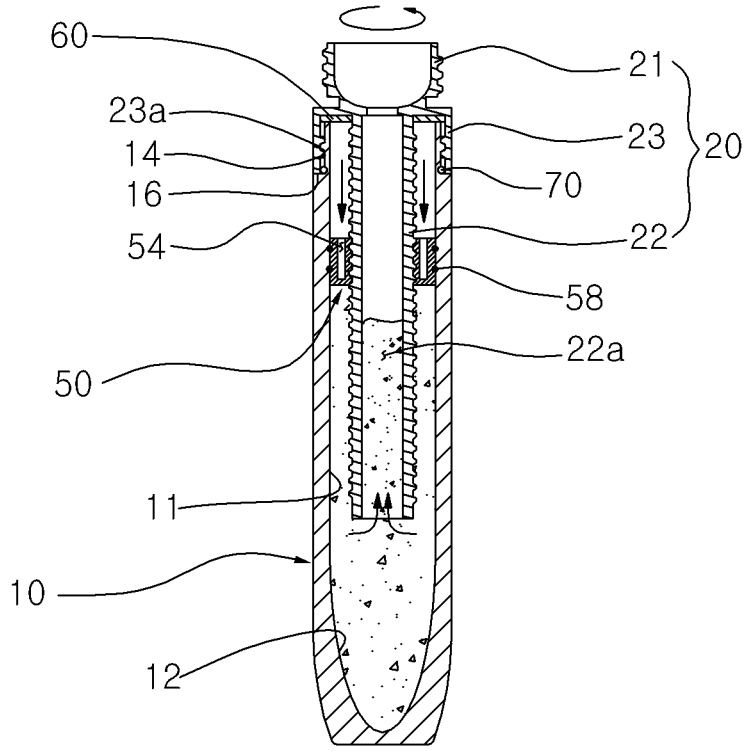
FIG. 6 is a sectional view showing a state in which a piston is moved downward by rotating a rotating member of the cosmetic container according to one embodiment of one aspect of the present disclosure.
Figure 7:
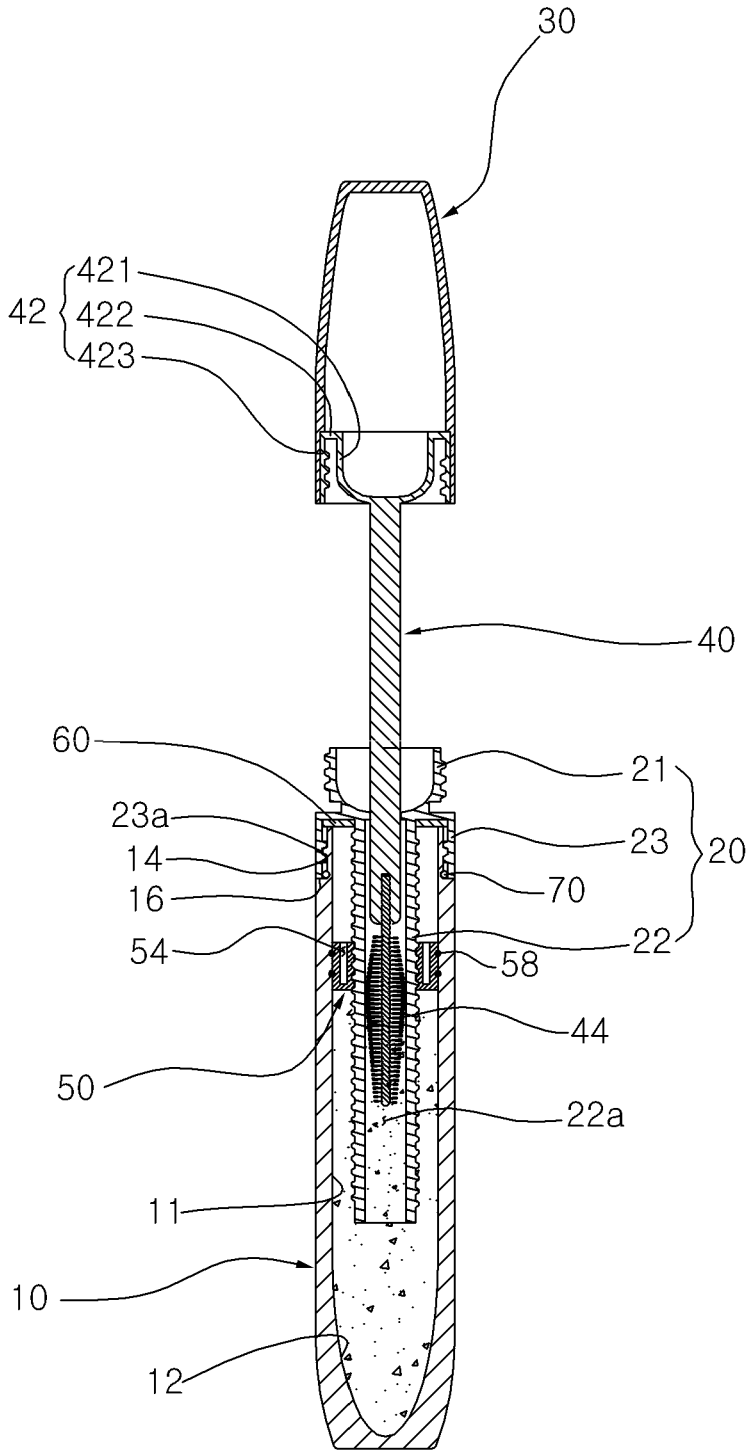
FIG. 7 is a sectional view showing a state in which a brush rod of the cosmetic container according to one embodiment of one aspect of the present disclosure is inserted into a cosmetics guide tube.
Figure 8:
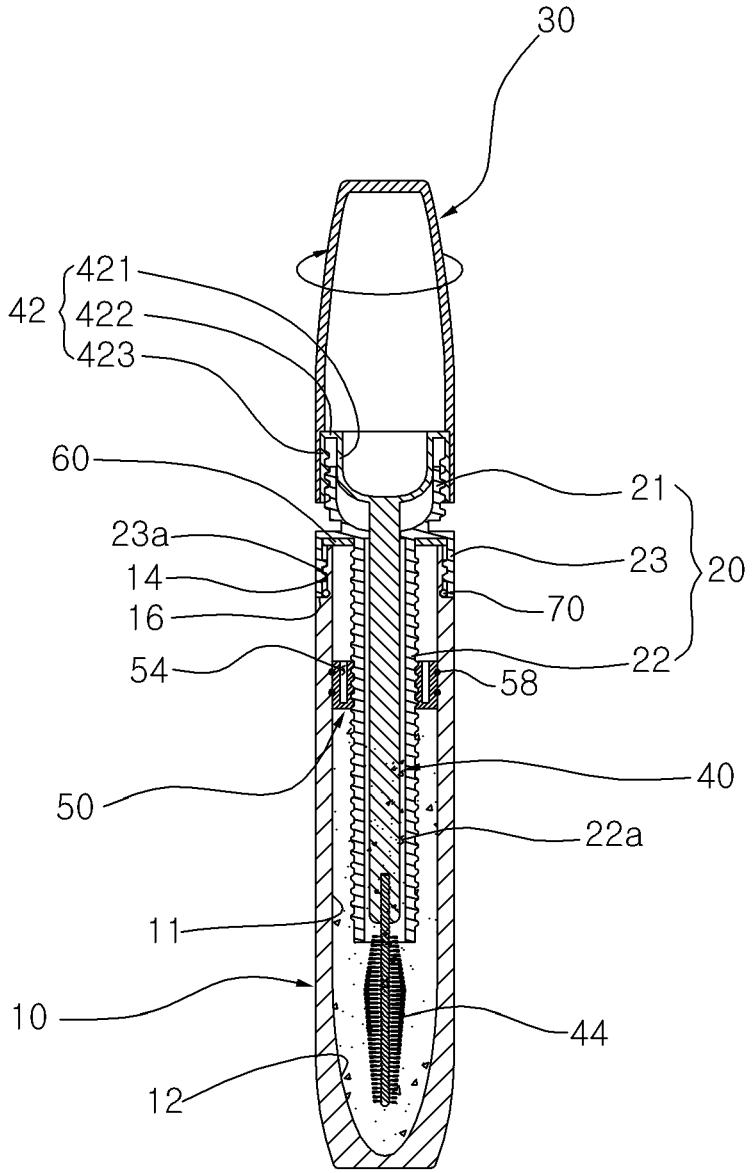
FIG. 8 is a sectional view showing a state in which the container cap is coupled to the container main body of the cosmetic container according to one embodiment of one aspect of the present disclosure.
Figure 9:
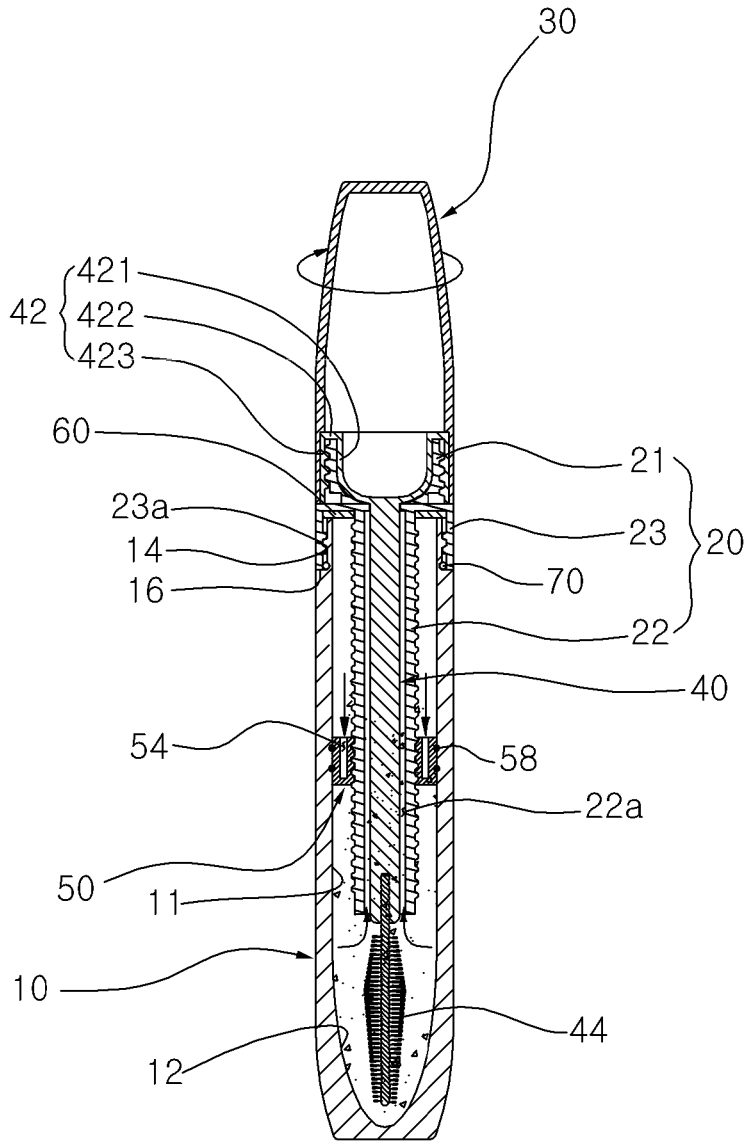
FIG. 9 is a sectional view showing a state in which the piston is moved downward by rotating the container cap of the cosmetic container according to one embodiment of one aspect of the present disclosure.

FIG. 5 is a sectional view showing a state in which a container cap is separated from a container main body of the cosmetic container according to one embodiment of one aspect of the present disclosure. FIG. 6 is a sectional view showing a state in which a piston is moved downward by rotating a rotating member of the cosmetic container according to one embodiment of one aspect of the present disclosure. FIG. 7 is a sectional view showing a state in which a brush rod of the cosmetic container according to one embodiment of one aspect of the present disclosure is inserted into a cosmetics guide tube. FIG. 8 is a sectional view showing a state in which the container cap is coupled to the container main body of the cosmetic container according to one embodiment of one aspect of the present disclosure. FIG. 9 is a sectional view showing a state in which the piston is moved downward by rotating the container cap of the cosmetic container according to one embodiment of one aspect of the present disclosure.

In order to use the cosmetic container according to one aspect of the present disclosure, the container main body 10 is held with one hand first, and the container cap 30 is rotated using the other hand, so that the container cap 30 is separated from the container main body 10 as shown in FIG. 5.

Then, the applicator 44 coupled to one end of the container cap 30 is touched to an area for makeup, and the makeup is performed using the cosmetics put on the applicator 44.

Then, when more cosmetics are required to be put on the applicator 44 for use, an entire rotating member 20 or a partial component of the rotating member 20, that is, the inlet portion 21 is rotated as shown in FIG. 6, so that the piston 50 screw-coupled to the cosmetics guide tube 22 of the rotating member 20 downwardly sweeps the cosmetics put on the inner peripheral surface of the container main body 10 while the piston 50 is moved downward, and simultaneously, the cosmetics contained in the container main body 10 is pushed upward into the cosmetics guide tube 22.

Then, as shown in FIG. 7, the brush rod 40 is inserted into the cosmetics guide tube 22 to put the cosmetics on the applicator 44. Even when the applicator 44 of the brush rod 40 is not inserted up to the bottom of the container main body 10, the cosmetics are put on the applicator 44.

After the makeup is completed, the brush rod 40 coupled to the lower portion of the container cap 30 is inserted into the cosmetics guide tube 22 of the rotating member 20, and the container cap 30 is rotated and closed as shown in FIG. 8.

Consecutively, when the container cap 30 is further rotated, the container cap 30 rotates the entire rotating member 20 or the part of the rotating member 20, that is, the inlet portion 21 and the cosmetics guide tube 22 as shown in FIG. 9, so that the piston 50 screw-coupled to the cosmetics guide tube 22 is moved downward and sweeps the cosmetic on the inner peripheral surface of the container main bock 10 downward, and simultaneously, the cosmetics contained in the container main body 10 is pushed upward into the cosmetics guide tube 22. As air inside the cosmetics guide tube 22 of the rotating member 20 is gradually compressed, the rotating member 20 is rotate in a predetermined section and stops the rotation due to the air pressure.

The description according to one aspect of the present disclosure is merely one embodiment for carrying out the cosmetics container simultaneously preventing leftover cosmetics therein and having an airtight function, and one aspect of the present disclosure is not limited to the embodiments. The preferred embodiments have been proposed and set forth in the aforementioned description, however the present invention should not be construed as limited thereto, and it will be apparent to those having ordinary skill in the art in that many different substitutions, deformations and modifications are available within the scope without departing from the invention.

DESCRIPTION OF REFERENCE NUMERAL

10: Container main body
20: Rotating member
21: Inlet portion
22: Cosmetics guide tube
23: Coupling portion
30: Container cap
40: Brush rod
44: Applicator
50: Piston
58: Piston sealing ring
60: Sealing packing
70: Sealing ring

The invention claimed is:

1. A cosmetics container simultaneously preventing leftover cosmetics therein and having an airtight function, the cosmetics container comprising:

a container main body accommodated therein with cosmetics;

a rotating member rotatably coupled to the container main body, and having a cosmetics guide tube extending from a lower side thereof so as to be inserted into the container main body;

a container cap for opening and closing the container main body;

a brush rod extending from the lower side of the container cap so as to be inserted into the cosmetics guide tube, and having an applicator provided at the end portion thereof; and a piston screw-coupled to an outer periphery of the cosmetics guide tube of the rotating member while the outer peripheral surface thereof comes in close contact with an inner peripheral surface of the container main body, wherein the rotating member includes an inlet portion, the cosmetics guide tube extending downward from the inlet portion, and a coupling portion spaced apart from the cosmetics guide tube at a predetermined interval and extending downward, wherein an inner circumference of the inlet portion of the rotating member includes a shape downwardly tapering toward a center of the rotating member, and wherein an upper outer circumference of the brush rod has a shape to tightly fit in the inlet portion of the rotating member.

2. The cosmetics container of claim 1, wherein the inner peripheral surface of the container main body and an outer peripheral surface of the piston have a polygonal shape.

3. The cosmetics container of claim 1, wherein the inlet portion, the cosmetics guide tube, and the coupling portion of the rotating member are formed integrally, or formed separately and coupled to each other.

4. The cosmetics container of claim 1, wherein the rotating member is entirely or partially rotated, so that the piston screw-coupled to the cosmetics guide tube of the rotating member sweeps cosmetics on the inner peripheral surface of the container main body while being moved downward and simultaneously upwardly pushes the cosmetics contained in the container main body into the cosmetics guide tube.

5. The cosmetics container of claim 4, wherein a thread is formed on an outer circumference of the inlet portion so as to be screw-coupled to an upper part of the brush rod such that a rotation of the brush rod to couple the brush rod to the inlet portion of the rotating member leads to a rotation of the rotating member moving the piston downward.

* * * * *